US006548776B1

(12) United States Patent
Jong

(10) Patent No.: US 6,548,776 B1
(45) Date of Patent: Apr. 15, 2003

(54) SAFETY DEVICE FOR ON/OFF SWITCH OF AN ELECTRIC TOOL

(75) Inventor: Ming-Fu Jong, Ping-Chang (TW)

(73) Assignee: Jenn Feng Industrial Co., Ltd., Ping-Chang (TW)

( * ) Notice: Subject to any disclaimer, the term of this patent is extended or adjusted under 35 U.S.C. 154(b) by 0 days.

(21) Appl. No.: 10/120,395

(22) Filed: Apr. 12, 2002

(51) Int. Cl.[7] ..... H01H 9/20
(52) U.S. Cl. ..... 200/334; 200/200; 200/42.01
(58) Field of Search ..... 200/42.01, 330–332, 200/344, 335, 337, 61.85

(56) References Cited

U.S. PATENT DOCUMENTS 4,335,286 A * 6/1982 Nelson ..... 200/302.1
5,161,679 A * 11/1992 Russo ..... 200/43.17
5,724,737 A * 3/1998 Stones ..... 30/228
6,005,208 A * 12/1999 Castonguay ..... 200/308
6,469,269 B1 * 10/2002 Jong ..... 200/522

* cited by examiner

*Primary Examiner*—Elvin Enad
*Assistant Examiner*—Lisa Klaus
(74) *Attorney, Agent, or Firm*—Browdy and Neimark, P.L.L.C.

(57) ABSTRACT

A safety device for on/off switch of an electric tool comprises a casing having a switch and a link assembly, in which the link assembly is composed of a knob, a first link lever, a second link lever, a trigger, and a dog. The pivotal joint correlation among those components are: the trigger, the second link lever, and the knob to the casing; the first link lever to the trigger; the second link lever to the first link lever; the knob to the second link lever; and a dog to the first link lever. Moreover, a protruding portion thereof is positioned corresponding to the switch. In operation of an electric tool of this kind, a user is requested to depress both said trigger and knob with his two hands respectively and simultaneously so that the dog is pulled upwardly to travel a longer-distance stroke to have its protruding portion depressed the switch to trigger the power, otherwise, by depressing either said trigger or knob with a single hand, the operation is in vain.

1 Claim, 5 Drawing Sheets

SAFETY DEVICE FOR ON/OFF SWITCH OF AN ELECTRIC TOOL

FIELD OF THE INVENTION

This invention relates generally to a safety device for on/off switch of an electric tool, particularly to a safety device for an on/off switch that can actuate an electric tool only when a user operates a specified start component with both hands simultaneously so as to avoid any unexpected action of the electric tool, which might be caused by an accidental touch with a single hand, and thereby ensure a user's safety in using that electric tool.

BACKGROUND OF THE INVENTION

Without exception, an electric tool is provided with an on/off switch for control operation of its motor. For example, a horticultural electric tool with trimming knife is usually provided with a trigger for a user to pull or release to drive or stop the tool.

In many cases, a single trigger is provided to a conventional electric tool for power on/off control, hence, it is a worry of latent danger in the case of a stand-by horticultural electric tool, which could be casually triggered by a user to drive the knife attached thereon that might hurt the user himself unexpectedly.

SUMMARY OF THE INVENTION

The primary objective of this invention is to provide a safety device for on/off switch of an electric tool, comprising a trigger and an interrelated knob. A user has to operate the trigger and the knob with his two hands simultaneously to switch on the power successfully, otherwise he would fail to do so should he use either hand only. Under this operation condition, any unexpected harm done upon a user by touching the trigger or the knob carelessly with a single hand is avoidable.

In order to realize abovesaid objective, the safety device for on/off switch of an electric tool comprises a casing having a switch and a link assembly. The link assembly is composed of a knob, a first link lever, a second link lever, a trigger, and a dog, in which the trigger, the second link lever, and the knob are pivotally jointed to the casing; the first link lever is pivotally jointed with the trigger; the second link lever is pivotally jointed with the first link lever; the knob is pivotally jointed with the second link lever; a dog is pivotally with the first link lever, and a protruding portion of the dog is positioned corresponding that of the switch. In the event when the trigger or the knob is depressed only by a single hand, the dog is pulled to have its protruding portion lifted to a position near the switch, or when both the trigger and the knob are depressed simultaneously, the dog is pulled to travel a longer-distance stroke to have its protruding portion pressed against the switch for actuating the power, such that a careless or casual touch onto the trigger or the knob by a single hand cannot switch on an electric tool to thereby avoid doing any unexpected harm to a user.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
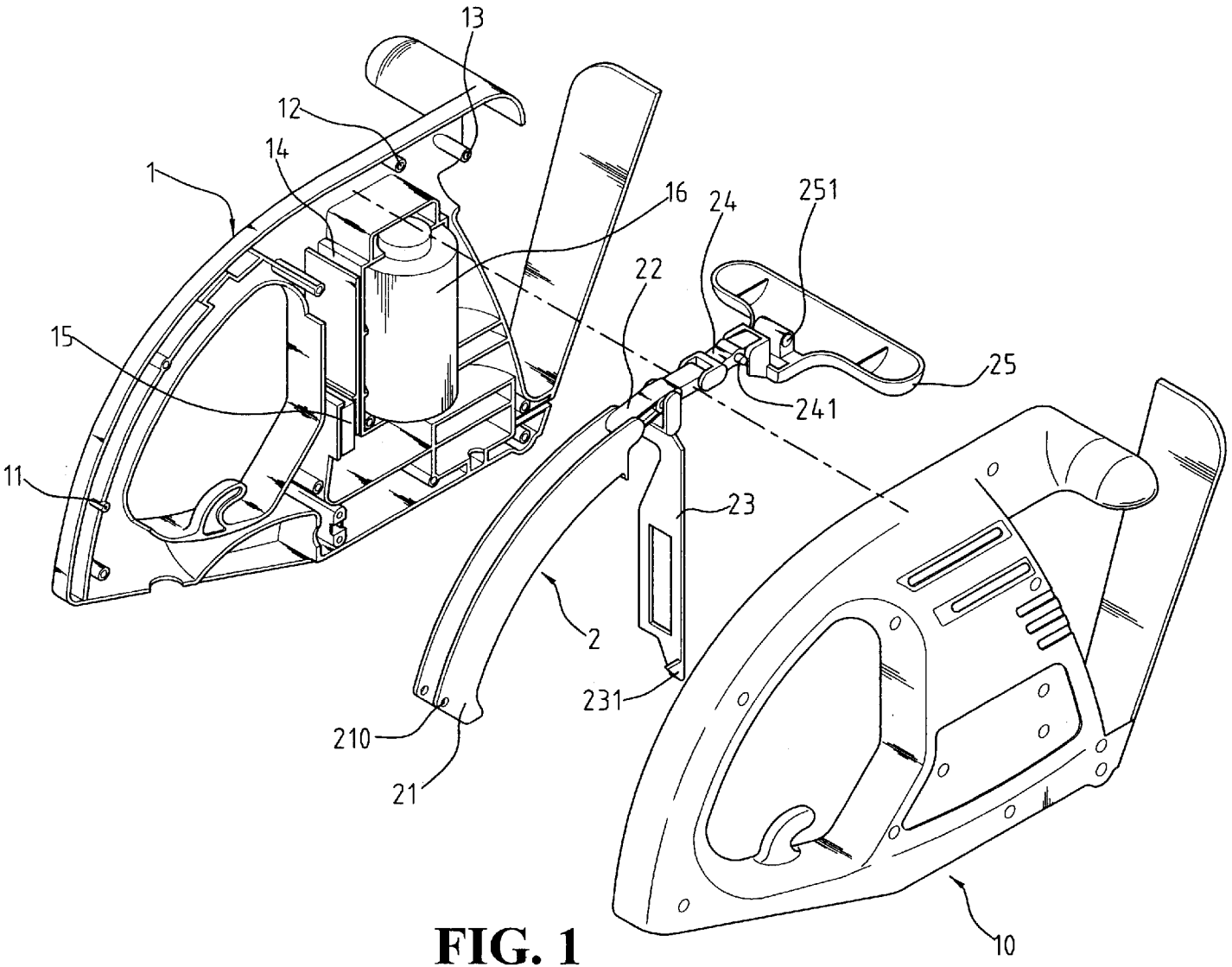
FIG. 1 is an exploded view showing all the components of this invention in three dimensions.

As illustrated in FIG. 1, a safety device of this invention for on/off switch of an electric tool comprises a casing 1, a lid 10 covered on the casing 1, and a link member 2 disposed in the casing 1.

The casing 1 has a first pivot 11, a pivotal jointing hole 12, and a second pivot 13 located in respective positions, and a longitudinal guide channel 14 which is provided with a switch 15 and a motor 16 on respective sides adjacent to the bottom end thereof. The lid 10 is correspondingly shaped to the casing 1 such that all the duly positioned components in the casing 1, including the link member 2, are covered by the lid 10 in order not to escape from the casing 1.

Figure 2:
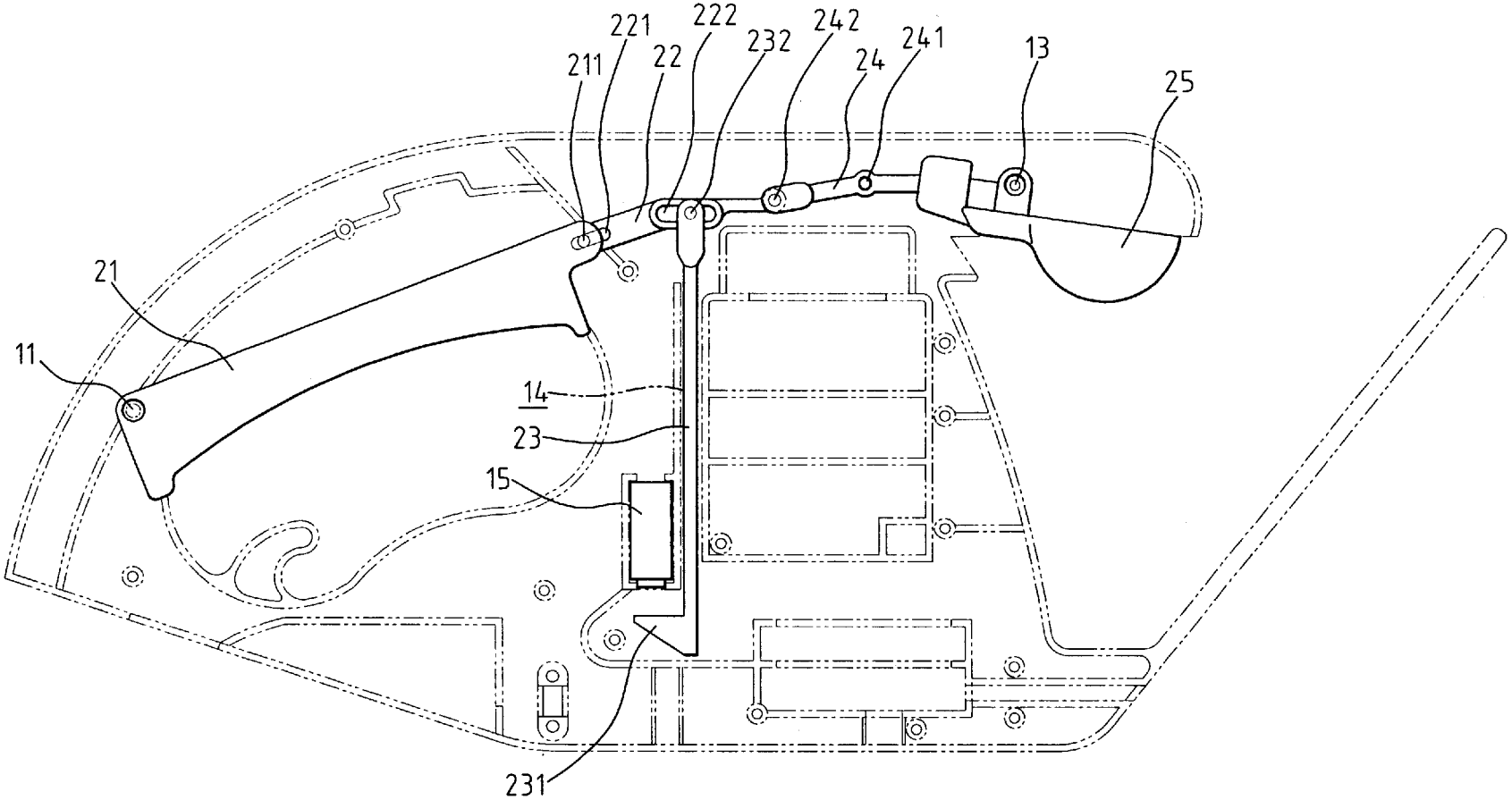
FIG. 2 is a plan view showing a link assembly in steady state in the casing of this invention.

Please refer to FIGS. 1 and 2. The link member 2 further comprises a knob 25, a first link lever 22, a second link lever 24, a trigger 21, and a dog 23. The knob 25 h as a con cave hole 251 formed at a proper position thereof to mate with the second pivot 13 for pivotally jointing the knob 25 to the casing 1 to enable the knob 25 to rotate relatively to the casing 1. The first link lever 22 has a first slot 221 formed at one end and a second slot 222 formed in a position adjacent to the midpoint thereof respectively. A pivot 241 is arranged on two respective sides of the second link lever 24 at a position near the midpoint thereof such that the pivot 241 is mated with the pivotal jointing hole 12 of the casing 1 and the lid 10 (not shown for the latter) such that the second link lever 24 can rotate relatively to the casing 1. Also, one end of the first and the second link levers 22, 24 are pivotally jointed through a link pivot 242 such that the first and the second link levers 22, 24 are allowed to rotate relatively to each other. Similarly, since the other end of the second link lever 24 is pivotally jointed to the knob 25, thus the second link lever 24 and the knob 25 can rotate relatively to each other too. Moreover, a hole 210 formed at one end of the trigger 21 is pivotally jointed with the casing 1 through the first pivot 11 while the other end of the trigger 21 is pivotally jointed the first slot 221 of the first link lever 22 through a link pivot 211. The dog 23 is a plate body arranged in and throughout the guide channel 14, in which one end thereof is pivotally jointed to the second slot 222 of the first link lever 22 through a link pivot 232 while the other end is a protruding portion 231 located in a position corresponding to the switch 15.

Figure 3:
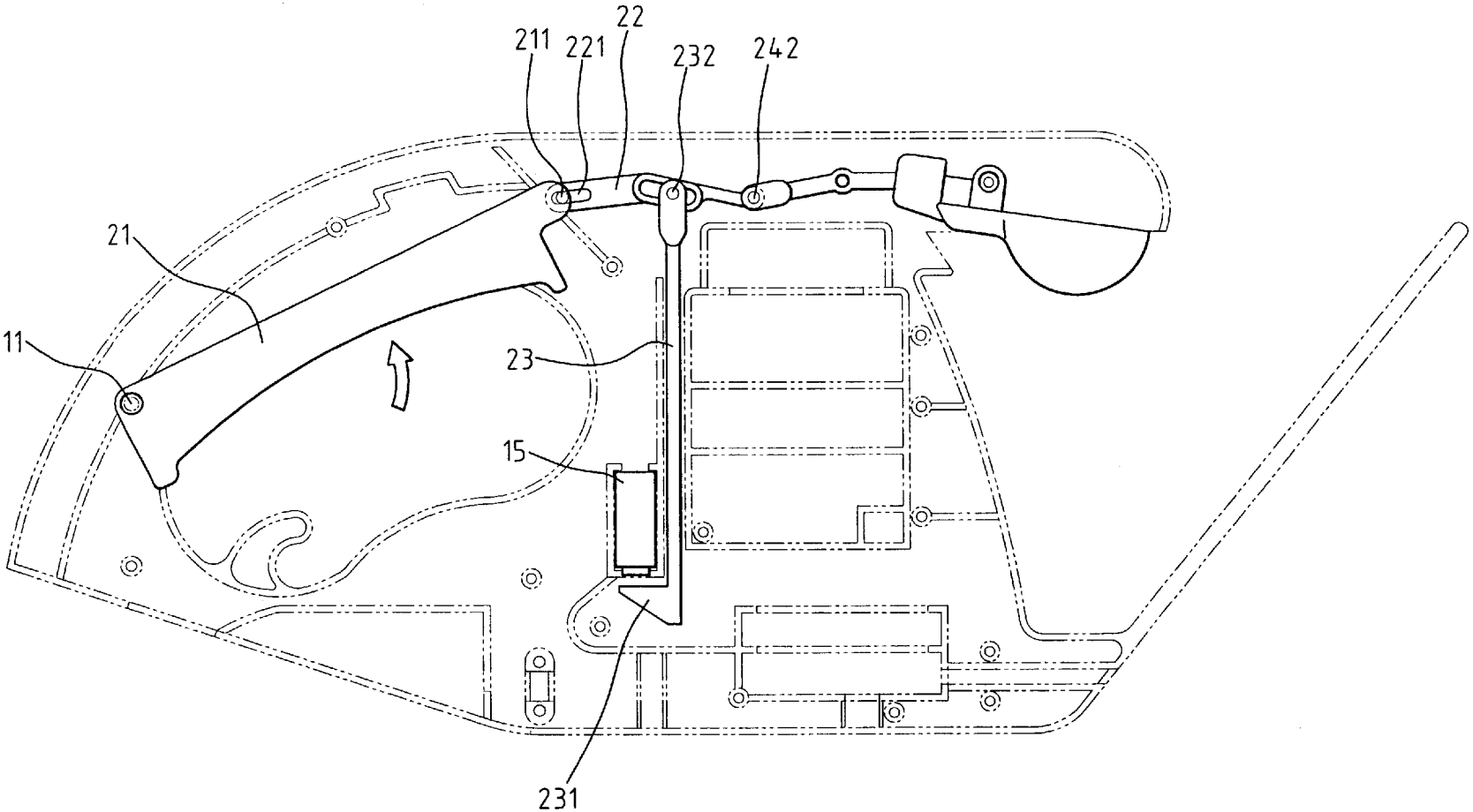
FIG. 3 is a plan view showing that a trigger in FIG. 2 is pulled up to drive related link levers, in which a dog is moved upwardly.

According to this invention, when both the trigger 21 and the knob 25 remain in a steady state (no external force applied) as indicated in FIG. 2, the distance between the protruding portion 231 of the dog 23 and the switch 15 is the maximum, and the switch 15 is kept untouched. Now, in the event the trigger 21 only is depressed as shown in FIG. 3, then it would take the first pivot 11 as the axis to rotate and further drive the link pivot 211 to move in the first slot 221 and in turn drive the first link lever 22 to deflect surrounding the link pivot 242 to consequently lift the dog 23 upwardly. However, because of the insufficient deflection angle of the first link lever 22, the dog 23 cannot be lifted farther for travelling a longer-distance stroke, therefore, as illustrated in FIG. 3, the protruding portion 231 can go nearer but not touch the switch 15 when the dog 23 moves upwardly to reach its upper dead point.

Figure 4:
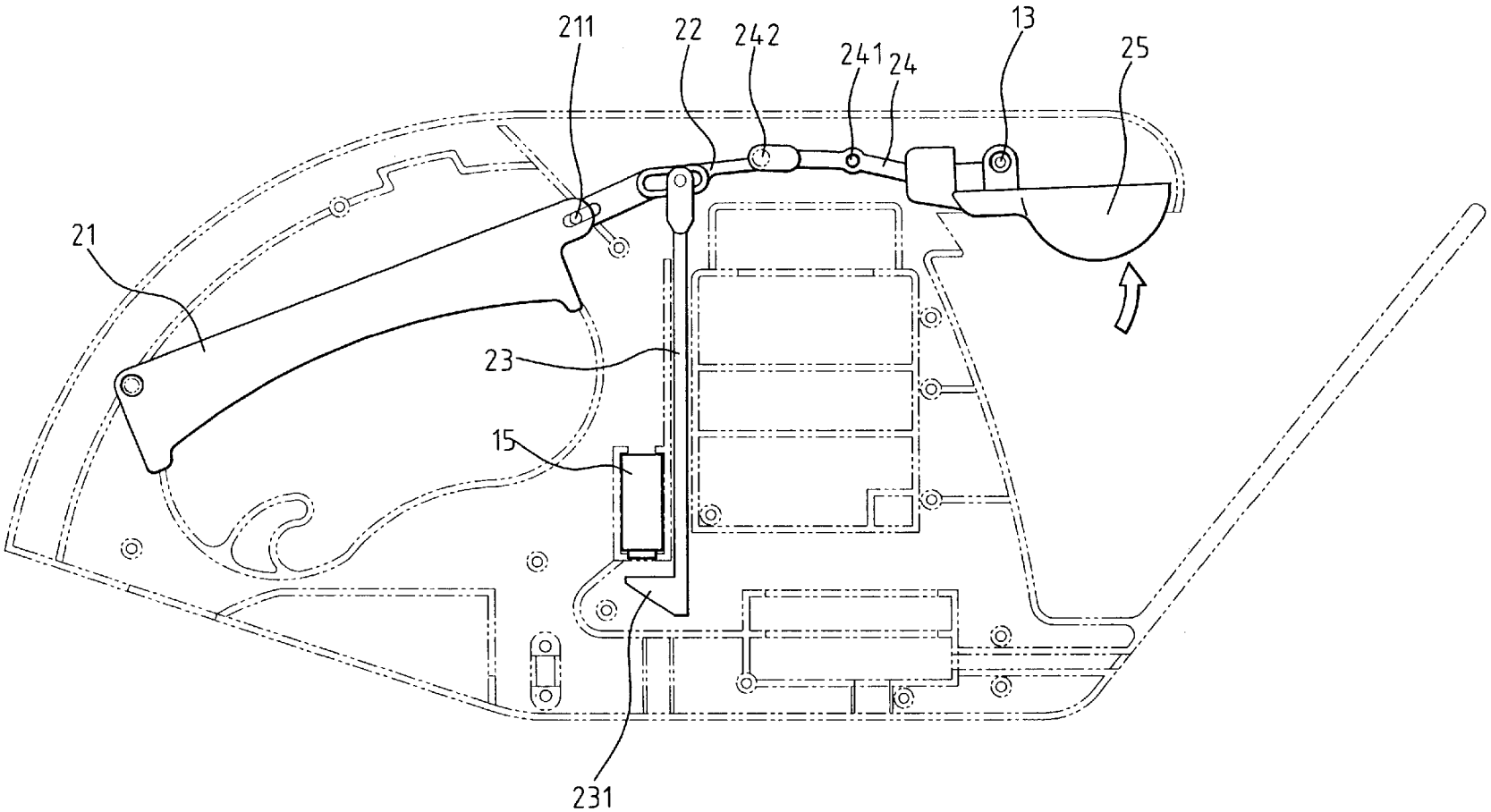
FIG. 4 is a plan view showing that a knob in FIG. 2 is pulled up to drive related link levers, in which the dog is moved upwardly.

FIG. 4 shows the case that a user depresses only the knob 25 instead of the trigger 21. In this case, the knob 25 would turn to deflect surrounding the second pivot 13 and drive the second link lever 24 to sway circling the pivot 241. Then, in turn, the second link lever 24 would drive the first link lever 22 through the link pivot 242 to deflect surrounding the link pivot 211 and consequently lift the dog 23 upwardly. Similar to the reason mentioned, the dog 23 cannot be lifted high enough to touch the switch 15 however has it gone nearer when the dog 23 reaches its upper dead point as indicated in FIG. 4.

Figure 5:
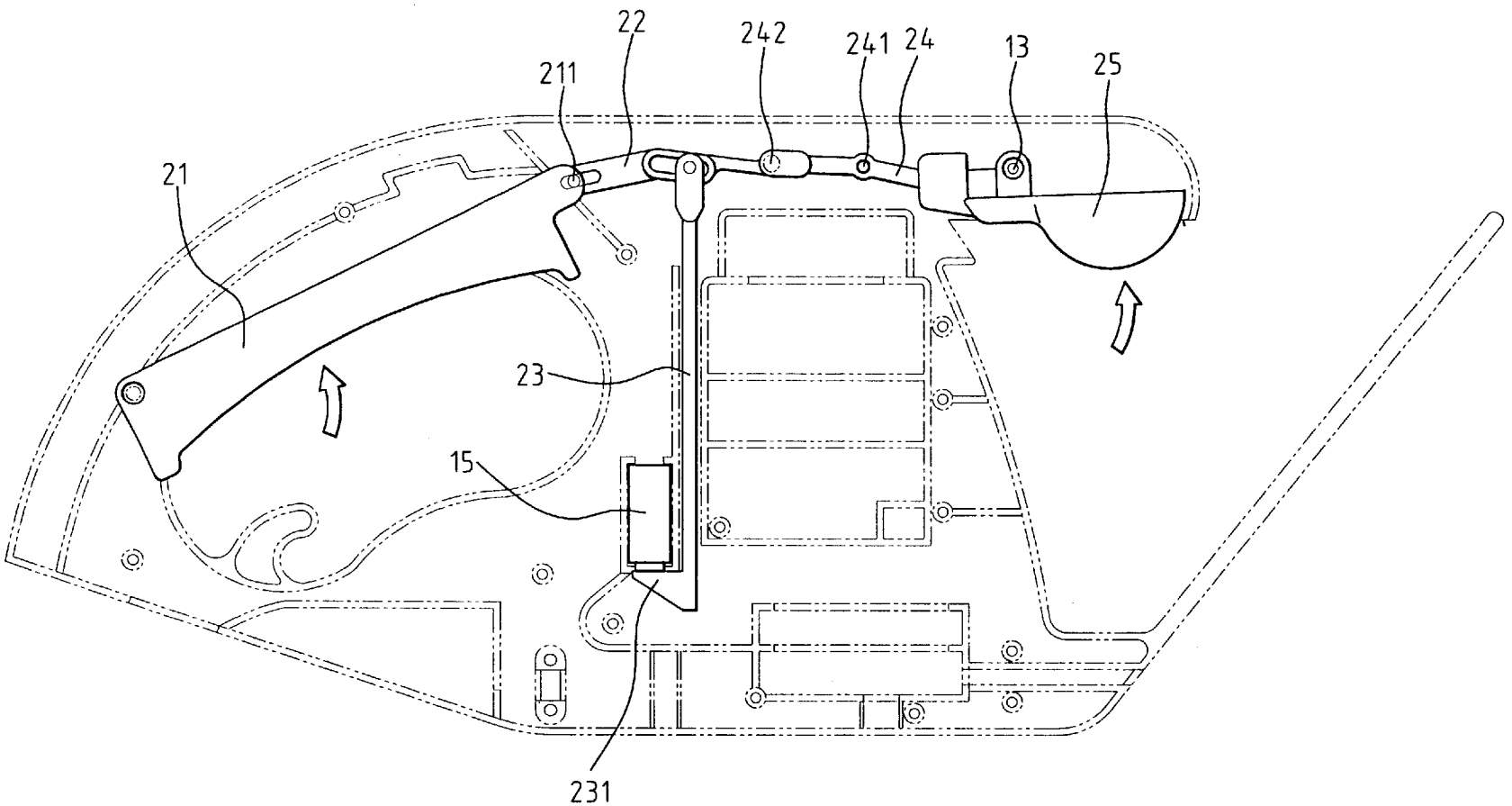
FIG. 5 is a plan view showing that both the trigger and knob in FIG. 2 are pulled up simultaneously to drive a protruding portion of the dog to depress a switch of an electric tool.

FIG. 5 shows the case that a user depresses the trigger 21 and the knob 25 simultaneously. In this case, the knob 25 would turn to deflect surrounding the second pivot 13 and drive the second link lever 24 to sway circling the pivot 241 and meanwhile lift the link pivot 242 to push the trigger 21 upwardly, such that the first link lever 22 is driven to deflect surrounding the link pivot 242 and consequently pull the dog 23 upwardly. At this time, because the link pivot 242 has been lifted higher, hence it is possible for the first link lever 22 to lift the dog 23 to travel a longer-distance stroke for the protruding portion 231 to depress the switch 15 and switch the power on.

Therefore, by using this invention, power cannot be actuated when a user employs a single hand to pull either the trigger 21 or the knob 25 so that accidents to be incurred by carelessness can be avoided. By the way, to control or operate the trigger 21 and the knob 25 simultaneously with two hands is a natural way to hold an electric tool stably without affecting dexterity and convenience of that tool.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A safety device for an on/off switch of electric tool, comprising:

a casing having a switch;

a knob pivotally jointed to said casing;

a first link lever having a first slot at one end and a second slot at a position adjacent to the midpoint thereof;

a second link lever having its midpoint pivotally jointed to said casing and one end pivotally jointed to one end of said first link lever while the other to said knob;

a trigger having one end pivotally jointed to said casing while the other to the first slot of said first link lever; and a dog having one end pivotally jointed to the second slot of said first link lever while the other is provided with a protruding portion at a position corresponding to said switch;

whereby, in operation of an electric tool of this kind, a user is requested to depress both said trigger and knob with his two hands respectively and simultaneously so that the dog is pulled upwardly to travel a longer-distance stroke to have its protruding portion depressed the switch, otherwise, by depressing either said trigger or knob with a single hand, the operation is in vain.

* * * * *